United States Patent [19]

Falxa et al.

[11] 4,419,442

[45] Dec. 6, 1983

[54] PHOTOSENSITIVE SILVER HALIDE EMULSION

[75] Inventors: Martin L. Falxa, Waltham; Richard S. Himmelwright, Melrose, both of Mass.

[73] Assignee: Polaroid Corporation, Cambridge, Mass.

[21] Appl. No.: 439,077

[22] Filed: Nov. 4, 1982

[51] Int. Cl.[3] ..... G03C 1/02

[52] U.S. Cl. ..... 430/567; 430/569

[58] Field of Search ..... 430/138, 567, 568, 569

[56] References Cited

U.S. PATENT DOCUMENTS 3,859,952 12/1974 Kenney ..... 430/569

*Primary Examiner*—Mary F. Downey

*Attorney, Agent, or Firm*—Philip G. Kiely

[57] ABSTRACT

Photosensitive silver halide grains are disclosed comprising a shell of silver halide substantially surrounding a water-soluble, non-silver containing grain as a core. Methods for forming silver halide grains having a water-soluble, non-silver containing core are also disclosed.

34 Claims, 5 Drawing Figures

PHOTOSENSITIVE SILVER HALIDE EMULSION

BACKGROUND OF THE INVENTION

Photosensitive silver halide emulsions are known in the art wherein the silver halide grains of said emulsions possess a core of silver halide having a first composition and an overcoat or shell of silver halide with a different composition. Such emulsions are known in the art as core-shell emulsions. One example of such a core-shell emulsion is found in U.S. Pat. No. 3,317,322 issued May 7, 1967 wherein the grains are described as comprising a central core of chemically sensitized silver halide and an outer shell of silver halide which is chemically sensitized subsequent to the formation of the outer shell. Other such core-shell emulsions are disclosed in U.S. Pat. No. 3,206,313 issued Sept. 14, 1965 and British Pat. No. 1,027,146 published Apr. 27, 1966.

The art has also searched for methods of providing photographic emulsions with a reduced silver content. Scarcity and expense of silver, which is one of the components of the photosensitive silver halide, makes reduced consumption of silver halide in photographic products extremely desirable.

U.K. Patent Application No. GB 2,063,499, published June 3, 1981, is directed to a photographic emulsion containing composite crystals of silver halide and copper halide or a solid solution crystal of copper halide and silver halide. The host crystal of copper halide or solid solution crystal of copper halide and silver halide is of the zinc blend type of crystal structure. The composite crystals may be prepared by adding an aqueous solution of a water-soluble halide and a silver salt solution to copper halide crystals so that silver halide is deposited through epitaxial junction on the copper halide or solid solution in the copper halide.

J. Phys. Chem. 35, 2005 (1931) discloses the growth of crystals on a substrate. Among the substances employed were those having a rock salt habit, such as sodium chloride and potassium chloride. Silver chloride is also disclosed as one of the crystals being grown on the substrate. The substrates disclosed are sheet crystals and the system employed in growing the crystals is aqueous.

The art has also disclosed the formation of AgCl single crystals on NaCl crystal bars by melting silver chloride and dipping the sodium chloride bar in the melt. This method is disclosed in Journal of Crystal Growth 41, 1977, 172–174.

The formation of crystals of AgI by condensing AgI in a vacuum chamber on a sheet substrate is described in Journal of Crystal Growth 7 (1970) 109–112. Among the substrates disclosed is sodium chloride.

U.S. Pat. No. 3,859,952, issued Dec. 17, 1974 is directed to silver halide deposited or absorbed on colloidal particles of a hydrous oxide of an element selected from the group consisting of Be, Mg, Ti, Zr, V, Cr, Mo, Fe, Mn, W, Co, Ni, Cu, Zn, Cd, Hg, Al, In, Si, Ge, Sn, Th and mixtures thereof. The method comprises mixing aqueous solutions of silver nitrate and a halide with insoluble hydrous oxide particles.

SUMMARY OF INVENTION

The present invention is directed to photosensitive silver halide grains comprising a shell of silver halide substantially surrounding a water soluble, non-silver containing grain as a core. Preferably, the core grain has a rock salt habit. The present invention is also directed to a method for forming a silver halide shell on said non-silver containing grain in a non-aqueous system. In one embodiment, the water-soluble core is removed prior to photographic employment.

DETAILED DESCRIPTION OF THE INVENTION

Figure 1:
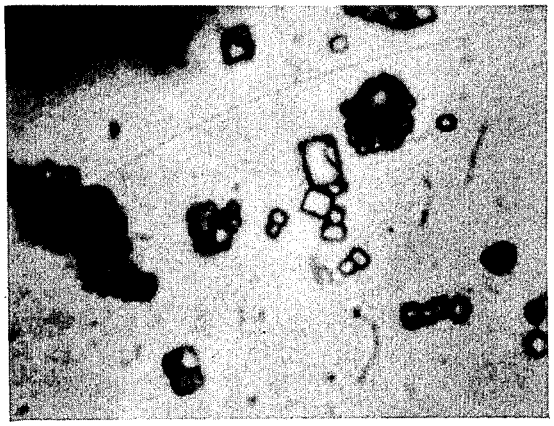
FIG. 1 is an optical micrograph of sodium chloride crystals in acetonitrile.

The novel photosensitive silver halide grains of the present invention comprise a shell of photosensitive silver halide substantially surrounding a non-silver containing water-soluble core. A number of advantages accrue to the novel grains of the present invention. Since the core grain is predominantly non-silver, significant savings are realized in diffusion transfer photographic elements employing these grains compared to conventional silver halide grains since, in diffusion transfer systems, generally a larger portion of the silver is not used. Therefore, only the necessary outer shell of silver is used and the interior, since it is not silver, is not wasted. Advantages can also be obtained by removing the water-soluble core prior to photographic utilization.

The novel method of the present invention comprises reacting a silver salt, such as silver nitrate, in a non-aqueous medium with a substrate consisting of grains of a non-silver, water-soluble alkali halide having a rock salt habit wherein the percent mismatch in the lattice parameters of the substrate and the silver halide to be formed on the substrate is less than about 15% as indicated by the formula:

$$\left[\frac{A_o\,(\text{overgrowth}) - A_o\,(\text{substrate})}{A_o\,(\text{substrate})}\right] \times 100 < 15\%$$

wherein $A_o$ is the lattice parameter.

The non-aqueous medium in which the grain formation takes place is one in which the added silver salt reactant is soluble but silver halide and the substrate are substantially insoluble.

The thus-formed grains may be employed in a variety of ways.

For example, in one embodiment the grains may be separated from the solvent solution, in which they were formed, dispersed in a suitable binder, e.g. gelatin, and coated on a support to form a photosensitive element. In another embodiment, the grains may be formed in the presence of a binder soluble in the solvent, e.g., polyvinyl pyrrolidone, and coated directly on a support to form a photosensitive element.

In an alternative embodiment the halide in the silver halide shell may be partially or fully converted to a different halide and then employed in a photosensitive element. In still another embodiment the thus-formed grains comprising a silver halide shell on a water-soluble core may be treated with water thereby dissolving away the water-soluble core, leaving a hollow structure comprising photosensitive silver halide. The hollow structure may be employed intact or it may be broken into flatter pieces both of which provide a larger surface area photosensitive layer than conventional grains.

The hollow silver halide grains are particularly useful in that in a photosensitive element they can function as relatively large grains upon exposure providing a relatively large projection area for light absorption. During development the hollow silver grains will function as if they were relatively fine grains, i.e., because of the large surface area available (the inside as well as the outside of the grain). Thus, the reaction between the silver halide and the photographic processing composition will be rapid.

The novel silver halide grains of the present invention can also be used to form an emulsion of low silver content which can be employed to record an image and which is then treated with a physical developer to increase density. Suitable physical developers may be found in Modern Photographic Processing, by Grant Haist, John Wiley & Sons (1979), Vol. 1, page 387.

The greatly increased surface area of the hollow grains also permits a larger quantity of sensitizing dye, chemical sensitizers and other addenda to be associated with the grain than would be possible with conventional silver halide grains.

As stated above, the novel method of present invention is carried out employing the above-described, non-silver, water-soluble grain having a rock salt habit as the substrate. Particularly preferred are the alkali halides such as sodium chloride, potassium chloride, and sodium bromide. Advantageously, development or dissolution releasable compounds that would impact on image quality may be incorporated into the substrate. For example, up to 30% of iodide may be incorporated into the core material which upon dissolution during development would be released thereby shutting down the development process.

The core or substrate grains are about 0.1 to 10 μm in diameter, preferably 1 to 2 μm. Such grains can be obtained by, for example, grinding or ball milling. In a particularly preferred embodiment, relatively uniform core grains are found by adding a conventional solution of the core material to a liquid in which it is insoluble with high speed stirring.

The core or substrate grains are dispersed in an organic solvent in which they are insoluble or substantially insoluble. A non-aqueous solution of a silver salt is added, and silver halide forms on the surface of the substrate grain by solution epitaxy. As stated above, for solution epitaxy to take place, the difference in lattice parameters between the silver halide and the core grain should be less than 15%.

As stated above, the solvent selected must possess three criteria. The substrate grain and silver halide must be insoluble or substantially insoluble in the solvent, and the added silver salt must be soluble in the solvent. As examples of suitable solvents mention may be made of methanol, ethanol, acetonitrile and acetone. Combinations of the above mentioned solvents may also be employed.

If desired, the grains of the present invention can be partially or fully converted to a different halide. For example, a silver chloride shell on a sodium chloride substrate can be partially or fully converted to silver bromide on a sodium chloride substrate by the addition of sodium bromide solution wherein a non-aqueous solvent or combination of solvents is employed. For example, in the case of sodium bromide, ethanol is preferred as the non-aqueous solvent.

Alternatively, the silver halide shell composed of mixed halides may be prepared by employing a core grain comprised of chloride and bromide. If iodile is also desired as a component of the silver halide shell a photographically useful amount of a soluble iodide salt such as KI or NaI is added to the solvent medium.

If desired, the water-soluble core may be easily removed by washing the grains in water. Since total coverage of the core by silver halide does not generally occur, access to the core by water is available for dissolving and removing the water-soluble core. While some break-up of the silver halide shell structure may occur, most of the silver halide retains the shape and configuration that it possessed on the water-soluble core. Analysis shows essentially no substrate present after the water wash indicating that the entire water-soluble substrate core has been removed.

Conversion of the silver halide from a more-soluble to a less-soluble halide may be carried out either in an aqueous system or in a system in which the core grain is insoluble. If it is carried out in the solvent system in which the core grain is insoluble, the entire grain remains intact and only the silver halide is converted. If the conversion is carried out in an aqueous system, conversion of the halide of the silver halide is accomplished but the water-soluble core is dissolved and the original structure of the silver halide is broken with the resultant loss of the hollow structure.

In an alternative embodiment, the grains of the present invention may be grown to any desired size by conventional grain-growing techniques. Thus, subsequent to grain formation, and conversion, if desired, silver nitrate and alkali halide may be jetted into a suspension of grains for a time sufficient to grow the grains to the desired size. If the water-soluble core is to be retained, the system must be non-aqueous. If the water-soluble core is to be removed, grain-growing may be carried out in an aqueous system.

Any suitable silver salt may be employed in forming the grains of the present invention, providing it is soluble in the solvent system employed and the anion is not photographically detrimental. As examples of suitable silver salts mention may be made of silver nitrate and silver perchlorate.

By means of the present invention a reduction in silver usage of approximately thirty percent can be achieved obtaining comparable results to silver halide grains which are entirely silver halide.

As stated above, the novel method of the present invention provides substantially complete coverage of the core grain with silver halide. Accordingly, the silver salt must be employed in an amount proportional to the available surface area of the core grain. As the mean volume diameter of the core grain is increased, the resulting surface area, for a given weight of core grain decreases. and thus less silver salt is required to provide the described silver halide shell structure. For example, for core grains about 2 μm mean diameter, silver nitrate at about 25 mol % is employed to provide substantially complete coverage of the water-soluble core grain. Employing a quantity of silver salt which provides a silver halide shell to substantially surround the core grain provides sufficient stability and integrity to the shell so that the shell remains intact after removal of the water-soluble core grain.

The following non-limiting examples illustrate the novel process of the present invention.

EXAMPLE 1

Figure 2:
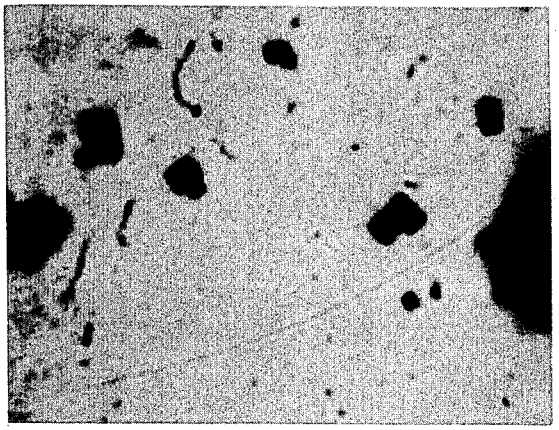
FIG. 2 is an optical micrograph of showing one embodiment of the novel grains of the present invention.

Sodium chloride crystals (40.0 grams), approximately 1.0–2.0 μm mean volume diameter, were dispersed in 100 mL of acetonitrile with vigorous stirring at room temperature in a red safe light. FIG. 1 is a photomicrograph at 1200X magnification showing the sodium chloride crystals in acetonitrile. To this dispersion was added 10 ml of acetonitrile containing 29.2 g of silver nitrate (25% mol % silver). After one hour the solution was filtered, and the precipitate washed with acetonitrile to remove excess silver nitrate. The resulting 25 mol % AgCl/NaCl grains yielded photolytic silver readily in ambient light as indicated by a darkening of the sample. Optical microscopy showed no change in the shape of the crystal from the original sodium chloride habit. Analysis confirmed that the silver content of the grain to be 25 mol %. Analysis for the free (water-soluble) chloride present indicated that some chloride ion is not soluble and thus is present as silver chloride. FIG. 2 is a photomicrograph as 1200X magnification showing the grains with silver chloride on the surface of the sodium chloride grain. The surface of the grains appear darker due to print-out silver formed from exposure by the microscope light source.

The following example illustrates the halide conversion of the grains of the present invention in an aqueous system.

EXAMPLE 2

Figure 3:
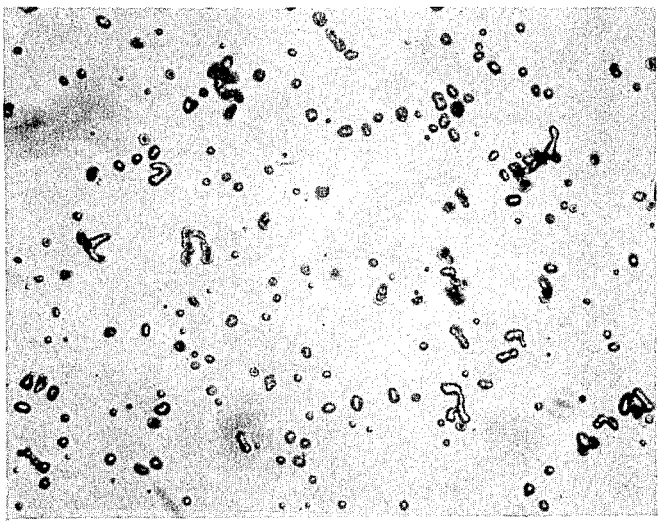
FIG. 3 is an optical micrograph showing another embodiment of the novel grains of the present invention.

To 200 mL of 0.1 M sodium bromide solution in water was added, 4.73 g of the AgCl/NaCl grains prepared according to the procedure of Example 1. The dispersion was stirred for 60 minutes and then filtered. X-ray analysis showed the resulting crystals to be converted to about 92% AgBr. These crystals were then dispersed in gelatin and coated on a substrate at a coverage of 300 mg/m$^2$ of silver and processed with a Type 107C processing composition and receiving sheet (Polaroid Corp., Cambridge, MA) yielding an image of the exposure target. Microscopic examination of the grains after conversion showed that the original shell morphology was lost. FIG. 3 is an optical micrograph at 1200X magnification showing the grains after conversion but before dispersion in gelatin. It will be seen that the sides of the cubes remained intact.

EXAMPLE 3

Figure 4:
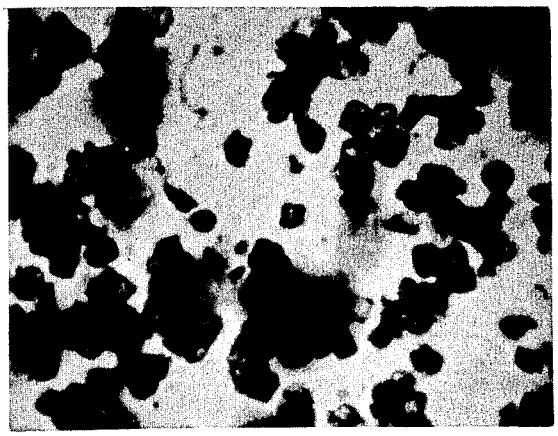
FIG. 4 is an optical micrograph showing still another embodiment of the novel grains of the present invention.

To 100 mL of a solution comprising 33.0 g of 5% polyvinyl pyrrolidone in acetonitrile, 67.0 g of a 50/50 mixture of methanol and acetonitrile, and 5.1 g of sodium bromide was added 4.73 g of the AgCl/NaCl grains prepared according to the procedure of Example 1. The dispersion was stirred for 60 minutes and then filtered. The precipitate was washed several times with methanol to remove excess reactants. The grains were then washed several times with water to remove the sodium chloride substrate core. The remaining precipitate was found by scanning transmission electron microscopy to contain in excess of 90% silver bromide. No sodium was found indicating substantially the entire removal of the water-soluble core. The shell structure was also found to remain intact as shown in FIG. 4 which is an optical micrograph at 1200X magnification of the converted grains.

EXAMPLE 4

Figure 5:
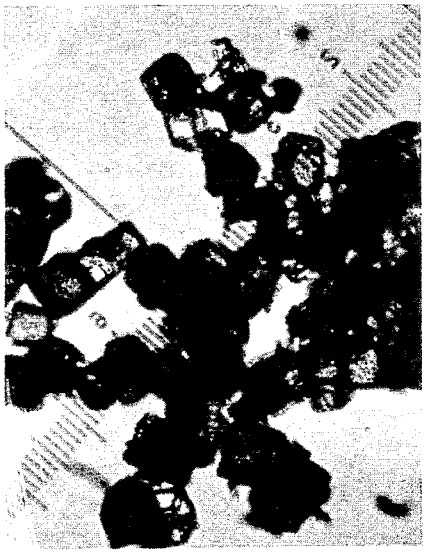
FIG. 5 is an optical micrograph showing yet another embodiment of the novel grains of the present invention.

About 5.0 g of AgCl/NaCl grains prepared according to the procedure of Example 1 using substrate sodium chloride grains about 5–10 μm in diameter were placed in 100 mL of distilled water at 25° C. with agitation for 15 min. Microscopic examination showed no change in the grain from the original sodium chloride habit and analysis showed the sodium chloride to be removed. FIG. 5 is an optical micrograph at 600X magnification showing the hollow grains.

The novel grains of the present invention may be treated and employed in the same way as conventional grains. Thus, the grains may be stabilized, sensitized, etc., so long as a non-aqueous system is employed to avoid removal of the core, if retention of the core is desired.

With regard to chemical sensitizing agents, suitable for use in the present invention mention may be made of U.S. Pat. Nos. 1,574,944; 1,623,499; 2,410,689; 2,597,856; 2,597,915; 2,487,850; 2,518,698; 2,521,926; and the like, as well as Neblette, C. B., *Photography, Its Materials and Processes,* 6th Ed., 1962.

Reduction sensitization of the grains prior to the addition of the binder may also be accomplished employing conventional materials known to the art, such a stannous chloride.

Sensitizers of the solid semiconductor type, such as lead oxide, may also be employed.

Spectral sensitization of the silver halide grains may be accomplihsed by contact of the grains with an effective concentration of the selected spectral sensitizing dyes dissolved in an appropriate dispersing solvent such as methanol, ethanol, acetone, water and the like; all according to the traditional procedures of the art, as described in Hamer, F. M., *The Cyanine Dyes and Related Compounds.*

Additional optional additives, such as coating aids, hardeners, viscosity-increasing agents, stabilizers, preservatives, and the like, for example, those set forth hereinafter, also may be incorporated in the emulsion formulation, according to the conventional procedures known in the photographic emulsion manufacturing art.

Silver halide emulsions prepared in accordance with this invention may be used, for example, in diffusion transfer processes for forming positive silver transfer images, both reflection prints and transparencies, including additive color transparencies, e.g., as disclosed and claimed in U.S. Pat. No. 3,894,871 issued July 15, 1975, and in subtractive multicolor diffusion transfer processes, particularly multicolor dye developer transfer processes, as disclosed and claimed, for example, in U.S. Pat. Nos. 2,983,606; 3,415,644 and 3,594,165.

What is claimed is:

1. Photosensitive silver halide grains comprising a shell of silver halide substantially surrounding a water-soluble, non-silver containing grain.

2. The product of claim 1 wherein said non-silver grain has a rock salt habit.

3. The product of claim 2 wherein said non-silver grain is an alkali halide.

4. The product of claim 3 wherein said alkali halide is sodium chloride.

5. The product of claim 3 wherein said alkali halide is sodium bromide.

6. The product of claim 3 wherein said alkali halide comprises mixed halide of chloride and bromide.

7. The product of claim 1 wherein said shell of silver halide is silver chloride.

8. The product of claim 1 wherein said shell of silver halide is silver bromide.

9. The product of claim 1 wherein said shell of silver halide is silver chlorobromide.

10. The product of claim 1 wherein said shell of silver halide includes iodide.

11. The product of claim 1 wherein said non-silver grain comprises up to about 30 mol% iodide.

12. A photosensitive silver halide emulsion comprising silver halide grains disposed in a polymeric binder wherein said grains comprise a shell of silver halide substantially surrounding a water-soluble, non-silver containing grain.

13. A substantially hollow photosensitive silver halide grain.

14. The product of claim 13 wherein said silver halide is silver chloride.

15. The product of claim 13 wherein said silver halide is silver bromide.

16. The product of claim 13 wherein said silver halide is silver chlorobromide.

17. The product of claim 13 wherein said silver halide includes silver iodine.

18. A method for forming photosensitive silver halide grains which comprises the steps of: (a) dispersing water-soluble, non-silver containing grains with a rock salt habit in an organic solvent in which said non-silver grains are insoluble; and, (b) adding a non-aqueous solution of a silver salt to said dispersion wherein silver halide is insoluble in said organic solvent.

19. The method of claim 18 which includes the step of separating the thus-formed grains from said solvent.

20. The method of claim 19 which includes the step of dispersing said grains in a polymeric binder and coating said grains on a support.

21. The method of claim 18 wherein said silver halide grains are silver chloride.

22. The method of claim 18 wherein said silver halide grains are sodium bromide.

23. The method of claim 18 wherein said silver halide grains are silver chlorobromide.

24. The method of claim 18 wherein said silver halide includes silver iodine.

25. The method of claim 18 wherein said water-soluble, non-silver grains are alkali halide grains.

26. The method of claim 18 wherein said non-silver containing grains comprise up to about 30 mol % iodine.

27. The method of claim 18 wherein said silver salt is silver nitrate.

28. The method of claim 18 wherein said organic solvent is acetonitrile.

29. The method of claim 18 wherein said solvent is methanol.

30. The method of claim 18 wherein said solvent is polyvinyl pyrrolidone in acetonitrile.

31. The method of claim 18 which includes the step of washing the thus-formed silver halide grains with water.

32. The method of claim 18 which includes the step of at least partially converting the halide of the said silver halide in an aqueous system.

33. The method of claim 18 which includes the step of at least partially converting the halide of said silver halide in an organic solvent which is a non-solvent for said non-silver grains.

34. The method of claim 18 which includes the step of growing said silver halide grains.

* * * * *